United States Patent [19]

Burd

[11] Patent Number: 4,739,524

[45] Date of Patent: Apr. 26, 1988

[54] DOUBLE WEEP HOLE DRAIN AND METHOD

[76] Inventor: Allen Burd, 12712 Michael Ave., Garden Grove, Calif. 92643

[21] Appl. No.: 858,588

[22] Filed: May 1, 1986

[51] Int. Cl.[4] ..... A47K 1/14

[52] U.S. Cl. ..... 4/286; 4/288; 4/289; 210/162; 210/165; 285/42

[58] Field of Search ..... 210/162, 165, 170; 285/42, 14; 4/286, 288, 289

[56] References Cited

U.S. PATENT DOCUMENTS

| | | | |
|---|---|---|---|
| 838,601 | 12/1906 | Willms | 4/286 |
| 1,482,216 | 1/1924 | Boosey | 210/165 |
| 1,749,878 | 3/1930 | Fleming | 210/165 |
| 2,222,807 | 11/1940 | Burr | 210/165 |
| 2,749,999 | 6/1956 | Schmid | 210/165 |
| 2,765,865 | 10/1956 | Schmidt | 285/42 |
| 2,859,452 | 11/1958 | Seewack | 210/165 |
| 3,420,552 | 1/1969 | Mork | 285/42 |
| 4,146,939 | 4/1979 | Izzi | 4/286 |

*Primary Examiner*—Henry E. Raduazo
*Attorney, Agent, or Firm*—Harry M. Weiss

[57] ABSTRACT

This invention relates to a floor drain and methods for its installation, more specifically to a floor or shower drain having two sets of weep holes and to a method for its installation.

Conventional drains generally in use today have only one set of weep holes to drain water which may seep down to a water impervious pan. As a result, if the shower stall is installed improperly, water may seep out and cause extensive water damage.

The invention relates to a shower drain installation which will be effective in preventing water damage even if the subfloor is not ideally suited for promoting drainage in a shower.

12 Claims, 1 Drawing Sheet

DOUBLE WEEP HOLE DRAIN AND METHOD

BACKGROUND OF THE INVENTION

This invention relates to a floor drain and methods for its installation, more specifically to a floor or shower drain having two sets of weep holes into a method for its installation.

Conventional drains generally in use today, have only one set of weep holes to drain water which may seep down to a water-impervious shower pan. The shower pan is placed over an unpitched and uneven subfloor, and because of this, the pan will have low spots that collect and hold water and which can never drain properly.

Consider a house or other structure in which a shower stall or other floor is to be provided with a drain. The subfloor under the shower stall is poured and shaped during the pouring of the slab for the rest of the house. This operation is done by concrete workers who are primarily concerned with properly finishing that portion of the slab which makes up the vast majority of the building floor. Little concern is shown for proper sloping of the subfloor under the shower stall. As a result, when the shower stall is installed and plumbed by a plumber, the subfloor is not ideally suited to promoting drainage of the shower. Also any structure in which a shower stall is installed in an upper floor may suffer extensive water damage due to leakage from an improperly installed shower stall.

A need therefore existed for an improved floor drain which would overcome the problems intended with conventional drains.

It is therefore an object of this invention to provide an improved floor drain apparatus.

It is another object of this invention to provide an improved floor drain for use with conventionally prepared subfloors.

It is a still further object of this invention to provide an improved method for installing a floor drain.

BRIEF SUMMARY OF THE INVENTION

The foregoing and other objects and advantages of the invention are achieved through the use of a double weep hole drain in accordance with the invention. According to one embodiment of the invention, the double weep hole drain consists of three (3) pieces: a lower portion, a center portion, and an upper portion. The three (3) portions, along with two (2) pieces of shower pan material, fold together to form a weep hole drain. Weep holes are provided at the bottom of both the center portion and the upper portion. In using the double weep hole drain, an intermediate and sloped flooring is provided between the subfloor and the finish floor.

DETAILED DESCRIPTION OF PERFERRED EMBODIMENTS

Figure 1:
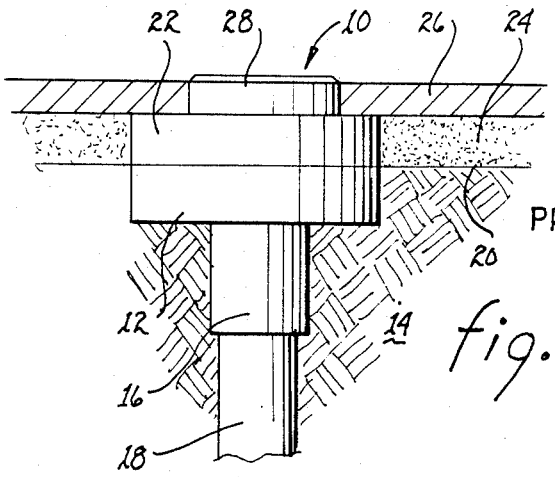
FIG. 1 illustrates, in cross section, a conventional floor drain in accordance with the prior art.

FIG. 1 illustrates, in cross section, a floor drain 10 in accordance with the prior art. Drain 10 includes, very briefly, a first portion 12 which is set in the subfloor 14 and has a bottom portion 16 which couples to a drain pipe 18. Subfloor 14 is generally an existing subfloor which is both unpitched and uneven. Over the subfloor and the top of the first portion 12, a shower pan 20 is positioned. A top portion 22 is attached to the first portion 12 with the shower pan 20 clamped between the two portions. Conventional weep holes (not shown) in top portion 22 provide for the drainage of water which collects on shower pan 20 if that collected water has the opportunity to flow to the drain and is not trapped by low spots in the subfloor. The installation of the conventional floor drain is continued by building up a layer of mortar 24 over pan 20. The bed of mortar is, in turn, covered by a finish coat of tile 26 or the like whose top surface is flushed with the top surface 28 of the drain or drain cover. Water which seeps through the tile layer 26 and the bed of mortar 24 collects on the shower pan 20. This water should drain through the weep holes to the drain pipe, but because of the difficulties enumerated above, some of this water fails to drain, remains stagnant on the pan, and presents a potential health hazard, and/or could result in structural damage if the pan should leak.

Figure 2:
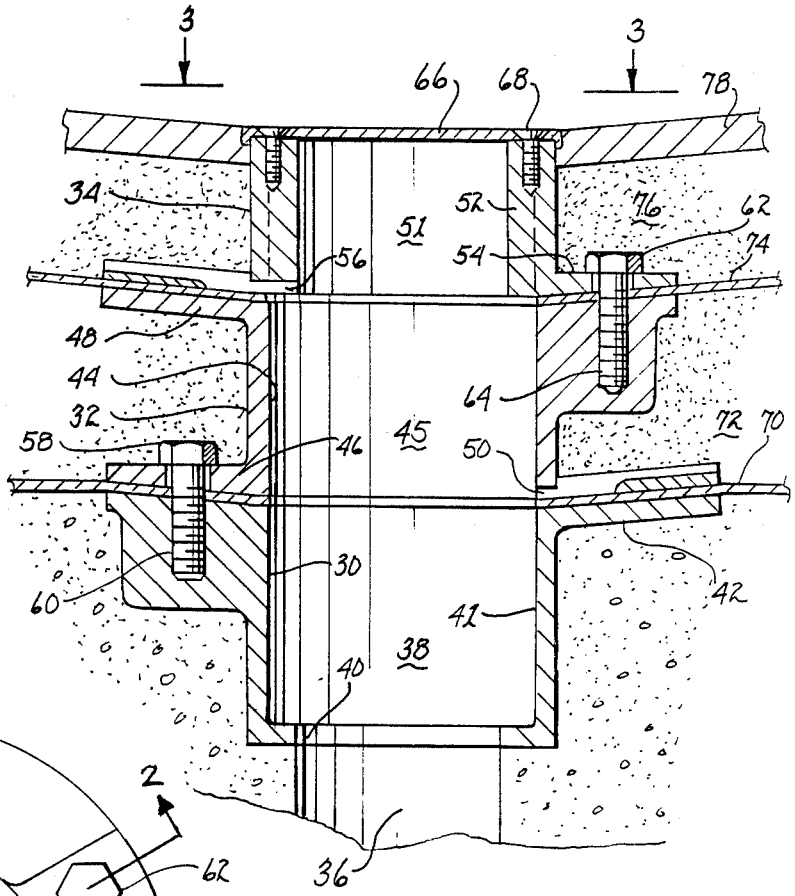
FIG. 2 illustrates, in cross section, a double weep hole drain in accordance with a preferred embodiment of the invention.
Figure 3:
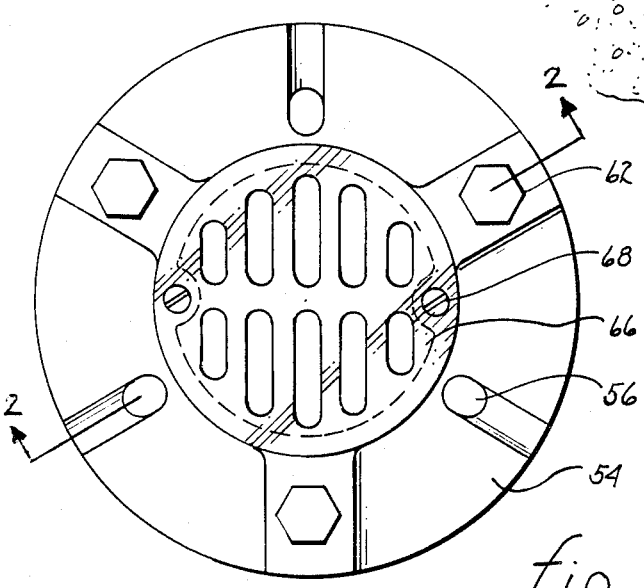
FIG. 3 illustrates, in top view, a double weep hole drain apparatus in accordance with the invention.

A floor drain in accordance with a preferred embodiment of the invention is illustrated in FIGS. 2 and 3. For ease of illustration, the invention is described in terms of a floor drain for a shower stall, but the drain can be equally applied to draining any other floor. FIG. 2 illustrates the section through the drain apparatus illustrated in FIG. 3.

The drain apparatus includes a lower portion 30, center portion 32, and upper portion 34. Each of the portions has a generally cylindrical center bore through which water drains to a drain pipe indicated schematically 36. The three portions of the drain apparatus are manufactured from any material such as metal or plastic that is approved by the codes and specifications of the building industry. The invention is not limited by the material from which the drain is fabricated.

Lower portion 30 includes a generally cylindrical wall 41 surrounding a center bore 38 which terminates in an opening 40 at the bottom extremeties. The opening 40 couples to drain pipe 36 by any method which is approved by the local industry codes and specifications. For example, the opening 40 and pipe 36 may be threaded and screwed together, or may be plastic and glued together. The lower portion also includes an annular collar 42 which extends outwardly from the top of the cylindrical portion 41. The annular collar is pitched to slope upwardly away from the cylindrical wall 41.

The center portion 32 also includes a generally cylindrical wall 44 surrounding a central bore 45. The center portion, further, has an annular flange 46 extending outwardly from the bottom of the cylindrical section 44 and sloped to mate with the annular collar 42 of the lower portion. The top of the center portion includes an annular collar 48 which extends outwardly and is pitched upwardly away from the cylindrical wall 44. A plurality of weep holes 50 (only 1 is shown in this view) extend through the annular flange and the cylindrical wall to provide a passage through which water can pass to the central bore.

The upper portion 34 is characterized by a cylindrical wall 52 surrounding a central bore 51. The bottom of the upper portion is characterized by an annular flange 54 which is shaped to mate with the annular collar 48 of the center portion. Flange 54 includes a plurality of weep holes 56 (only 1 is shown in this view) which extend through the flange and the cylindrical wall to allow drainage of moisture into the central bore 51.

The lower portion and the center portion are joined together, for example, by bolts 58 which pass through flange 46 and thread into a threaded portion 60 of the annular collar 42. Likewise, the upper portion 34 is joined to the center portion 32, for example, by a plurality of bolts 62 which pass through flange 54 and screw into a threaded portion 64 provided in collar 48. In a preferred embodiment three bolts are used to join the lower and center portions and three more bolts are used to join the center and upper portions. The bolts are equally spaced about the periphery of the drain apparatus.

In a preferred embodiment three weep holes are provided in flange 46 and an additional three weep holes are provided in flange 54. The weep holes are equally spaced at 120 degree increments about the periphery drain apparatus. Preferably, weep holes 50 in flange 46 are offset by 60 degrees from the weep holes 56 in flange 54. More than three weep holes could be used in each portion, but three weep holes in each portion have generally been found to be adequate.

A grate 66 is attached to the top of the upper portion to complete the floor drain. A grate is attached, for example, by screws 68 which tap into the cylindrical wall 52 of upper portion. Grate 66 allows for the passage of water into the drain but keeps other debris out of the drain.

To install the floor drain apparatus in accordance with the invention, lower portion 30 is attached to drain pipe 36 in accordance with local industry codes and specifications. The drain pipe is properly located in the shower stall prior to the pouring of the subfloor. The subfloor itself is generally unpitched concrete or the like. The lower portion is installed so that the upper surface of annular collar 42 is approximately flush with the upper surface of the subfloor. A shower pan or drain pan 70 made of water-impervious material is placed over the lower portion of the drain, extends out over the subfloor, and up the walls preferably about 12 inches, on all sides of the shower stall. Shower pan 70 is plastic, treated paper, sheet metal or the like.

The center portion 44 is placed on top of the first piece of shower pan material and is bolted to the lower portion of the drain apparatus. Holes for the bolts are positioned so that once bolted in place the central bores of the lower portion and center portion are aligned. Holding the two (2) portions together clamps the shower pan material between the annular collar 42 of the lower portion and the flange 46 of the center portion.

A bed of mortar or other building material 72 is formed on top of the first piece of shower pan material 70. The top of the mortar bed is flushed with the top of the center portion of the drain and is pitched at an angle, in accordance with building codes and specifications, so that any water on the surface will run towards the drain.

A second piece of shower pan material is placed over the center portion of the drain, over the surface of mortar bed 72, and approximately 6 inches up the walls on all sides of the shower.

The upper portion of the drain is placed on top of the second piece of shower pan material and is bolted to the center portion of the drain. Again, the holes in the center portion and upper portion are properly positioned so that when bolted together the bores of the center and upper portion align. Bolting the upper portion to the center portion clamps the second piece of shower pan material between the annular collar 48 of the center portion and the annular flange 54 of the upper portion.

A second bed of mortar or other building material 76 is formed on top of the second piece of shower pan material. The top surface of the second bed of mortar is located so that when a finish layer 78 is installed on top of the mortar bed 76 the top of the finish layer will be flush with the top of the grated drain cover 66 when it is screwed to the top of the upper portion of the drain. The top surface of the second mortar bed is pitched at an angle, in accordance with building codes and specifications, so that water on this surface runs toward the drain. The finish layer 78 can be tile, poured acrylic material, or the like. Because of the pitch in the second mortar bed 76, the finish layer 78 will also be pitched so that the water on layer 78 will run toward the drain. A grated drain cover 66 is then screwed to the top of the upper portion to complete the assembly and installation of the double weep hole drain.

The double weep hole drain shown in FIG. 2, uses two sets of weep holes, one set in each of the center portion and upper portion together with two shower pans. The use of the pitched mortar bed 72 together with the second shower pan 74 and the second set of weep holes insures that all water which seeps through the finish layer 78 and second bed of mortar 76 will find its way to the drain. Because of its nature, water will seep past the tile, through the mortar, and down to shower pan 74. Because this shower pan is pitched water will drain to the upper set of weep holes. Under most conditions, water should never get below shower pan 74. If the shower pan 74 is damaged or otherwise loses its integrity the water will be caught by the lower shower pan 70. Even though the lower pan is unpitched and may be set on an uneven subfloor, the lower set of weep holes 50 will drain off the water which finds its way to that lower level, except for that which settles in the uneven low spots.

Thus it is apparent that there has been provided, in accordance with the invention, a floor drain apparatus and method for its installation which fully meets the objects and advantages set forth above. Although the invention has been described and illustrated with reference to specific embodiments thereof, it is not intended that the invention be limited to these illustrative embodiments. Those skilled in the art will recognize, after review of the foregoing detailed description, that variations and modifications are possible without departing from the spirit of the invention. For example, other means may be used to join the three portions together, and other materials may be used in place of the mortar bed or tile. Accordingly, it is intended to include within the invention all such variations and modifications which fall within the scope of the appended claims.

What is claimed is:

1. Floor drain apparatus comprising three (3) sections through which water drains from a floor including:

a first lower section comprising a first cylindrical drain segment and a first annular collar extending outwardly from the top of said first segment and sloping upwardly therefrom;

a second center section including a second cylindrical drain segment, a first annular flange extending outwardly from the bottom thereof and capable of joining with said first annular collar, a first plurality of weep holes passing through said first annular flange and said second segment and a second annular collar extending outwardly from the top of said second segment and sloping upwardly therefrom;

a third upper section including a third cylindrical drain segment, a second annular flange extending outwardly from the bottom thereof and capable of joining with said second annular collar, a second plurality of weep holes passing through said second annular flange and said third segment;

and means for joining said first section to said second section and said section to said third section to align said first, second and third segments in axial alignment.

2. The floor drain apparatus of claim 1 wherein said means for joining comprise means for the bolting said first flange to said first collar and said second flange to said second collar.

3. The floor drain apparatus of claim 2 wherein said first flange and said first collar are adapted to clamp a first shower pan therebetween and said second flange and said second collar are adapted to clamp a second shower pan therebetween.

4. The floor drain apparatus of claim 1 wherein said first section is adapted for coupling to a drain pipe.

5. The floor drain apparatus of claim 1 wherein said third section is adapted for receiving a grate member.

6. The floor drain apparatus of claim 1 wherein said first and second plurality of weep holes are each positioned in equal increments about the periphery of said second and third sections, respectively.

7. The floor drain apparatus of claim 6 wherein said first plurality of weep holes comprises three (3) weep holes spaced at 120 degree increments about the periphery of said second section and said second plurality of weep holes comprises three (3) weep holes spaced at 120 degree increments about the periphery of said third section.

8. The floor drain apparatus of claim 7 wherein said first plurality of weep holes are positioned 60 degrees out of alignment with said second plurality of weep holes.

9. Floor drain apparatus comprising:

first, second and third sections joinable together in axial alignment defining portions of a drain passage;

and weep holes through each of said second and third sections for conveying seepage to said drain passage, said weep holes in said second section being vertically displaced with respect to said weep holes in said third section.

10. The floor drain apparatus of claim 9 wherein said three sections bolt together.

11. The floor drain apparatus of claim 9 further comprising means to couple a shower pan between said first and second sections and between said second and third sections.

12. The floor drain apparatus of claim 9 further comprising a grate member fastened to the top of said third section and positioned substantially in the plane of the upper surface of the floor.

* * * * *